US005356214A

United States Patent [19]

Styles

[11] Patent Number: 5,356,214

[45] Date of Patent: Oct. 18, 1994

[54] MIXER SUPPORT STRUCTURE WITH INTEGRAL HOIST

[75] Inventor: Richard Styles, Redmond, Wash.

[73] Assignee: Richard Styles & Associates, Inc., Redmond, Wash.

[21] Appl. No.: 52,146

[22] Filed: Apr. 23, 1993

[51] Int. Cl.[5] ..... B01F 7/22

[52] U.S. Cl. ..... 366/285; 414/917

[58] Field of Search ..... 366/285, 286, 279, 155, 366/348, 349; 414/917; 248/669, 79, 560, 651, 564

[56] References Cited

U.S. PATENT DOCUMENTS

| | | | |
|---|---|---|---|
| 1,689,103 | 10/1928 | Bendixen | 248/669 |
| 1,803,446 | 5/1931 | Warrick | 248/560 |
| 5,082,127 | 1/1992 | Huang | 212/265 |
| 5,150,866 | 9/1992 | Karpisek | 248/79 |
| 5,150,999 | 9/1992 | Dugan | 414/24.5 |

*Primary Examiner*—Robert W. Jenkins
*Attorney, Agent, or Firm*—Paul L. Griffiths

[57] ABSTRACT

The hoist disclosed provides four point pivotal connections of linkages enabling the hoist to raise and lower a rotating shaft in vertical translation while providing resistance to torsioned loads transmitted by the shaft. The hoist may be fitted with a hydraulic cylinder for raising or lowering a boom formed by the linkages. The hoist can be mounted to a structural portion of a building or mounted on a dolly having wheels for ease of movement on a floor. The hoist allows one person to safely mix the contents of large containers, such as 55 gallon drums on totes.

19 Claims, 3 Drawing Sheets

MIXER SUPPORT STRUCTURE WITH INTEGRAL HOIST

DESCRIPTION

1. Technical Field

The present invention relates to a hoist adapted to raise and lower a power driven shaft in a linear fashion. The hoist is further capable of countering any rotational moments acting to move the shaft off of its rotational axis. In particular, the shaft is part of a motor driven mixer for mixing liquid compounds.

2. Background Information

Traditionally, liquids such as paints are mixed during processing and then shipped in various sized containers to distributors and/or retailers. Either during shipment or storage, the different components separate and must be re-mixed before the paint can be used. In reality, any liquid prone to separation during transit or storage must be re-mixed before it can be used. Larger containers, such as 55 gallon drums or totes (square containers shipped on standard pallets), are re-mixed using a power mixer having an impeller or propeller attached to a lower portion of the mixer's shaft.

The mixer generally has an electric motor, a speed reduction unit, an impeller shaft and an impeller. For use in a 55 gallon drum or the like, the free end of the shaft must be raised above the top edge or rim of the drum. The mixer must then be lowered into the drum such that the impeller is sufficiently immersed to effectively mix the liquid.

A power mixer, as described above, is generally too heavy for one or two people to easily lift into a 55 gallon drum or the like. In addition, the mixer must generally be held in position and supported by a structure separate from the drum. Given the fact that a 55 gallon drum has a restricted diameter, and that the impeller shaft would normally be centered within the drum, the mixer hoist must have a long enough boom to suspend the mixer over the center of the drum. The boom must also be capable of raising and lowering the mixer while maintaining the mixer shaft in a vertical orientation. As an example, U.S. Pat. No. 5,150,866, issued to Karpisek on Sep. 29, 1992, discloses a frame having pivot points such that the end of a boom can be raised and lowered while maintaining a vertical orientation. This reference discloses a support for holding a hose for filling a liquid into a container having a plastic bag therein and does not have the necessary configuration to resist the torque generated by an impeller.

An example of a ground supported hoist using a hydraulic jack is disclosed by U.S. Pat. No. 5,082,127 issued to Huang on Jan. 21, 1992. This reference discloses a vertical support having a single arm or boom extending outwardly therefrom, which is raised and lowered by a jack having one end attached to the arm and the other end attached to the vertical support. This type of hoist does not allow for the rigid attachment of the object being raised or lowered, but only has a hook which is pivotally attached to the end of the arm.

An inherent characteristic of an impeller style mixer is that during start-up the free end of the impeller shaft wants to move from its vertical orientation due to the torque of the shaft and the forces upon the impeller. In order to prevent the free end of the impeller shaft from moving off its center of rotation, which could potentially cause the impeller to strike the side of the drum or container, the mixer motor and reduction gear must be securely held in position.

None of the references cited above, either alone or in combination, disclose a mixer hoist capable of supporting a mixer during start-up. The present invention allows a single person to position the impeller shaft over the center of a container and lower the impeller shaft into said container, and raise the shaft out of the container such that the mixing operation can be conducted by a single person.

SUMMARY OF THE INVENTION

The present invention provides a hoist having a support structure and a boom that are sufficiently rigid to retain an impeller shaft in a centered position within a container holding a liquid to be mixed such that upon start-up of the mixer motor the shaft is held in place with little or no sideways movement. A mixer hoist in accordance with the present invention includes a support structure which extends above a container holding a liquid to be mixed. A boom having space apart sets of parallelogram linkages providing a four point pivotal connection with a journal attachment and the support structure. A mounting frame which includes a mounting plate for receiving a mixer mounting flange is pivotally attached to the boom for supporting the mixer a predetermined distance from the support structure. The boom is constructed to resist the torque around an axis passing through the mixer's impeller shaft. The boom is also pivotally attached to the support structure. A means for raising and lowering the boom is pivotally attached to the support structure and pivotally attached to the boom. While the support structure could be a structural wall or column of a building, a preferred embodiment is that the structure comprises a vertical frame member attached to horizontal frame members which include wheels for maneuvering the structure around on a firm surface, such as a floor. The horizontal frame members are spaced such that they can accommodate a 55 gallon drum or the like, as well as larger containers.

The boom includes four tubular links which form a parallelogram. Each of the four links has one of their ends pivotally attached to the support structure. The other end of each link is pivotally attached to the mixer support frame. A linear motor, such as a hydraulic jack, is adapted for raising and lowering the boom. One end of the jack is pivotally attached to the support member while the second end of the jack is pivotally attached to the boom. In the preferred embodiment, the upper end of the jack is attached to the lower pair of links.

These and other objects and features and a more complete understanding of the aspects of this invention will be apparent from the following detailed description which taken in conjunction with the drawings represents a preferred embodiment of this invention.

BRIEF DESCRIPTION OF THE DRAWINGS

In the drawings, like reference numerals and characters refer to like parts throughout the various views, and wherein.

BEST MODE FOR CARRYING OUT THE INVENTION

Figure 1:
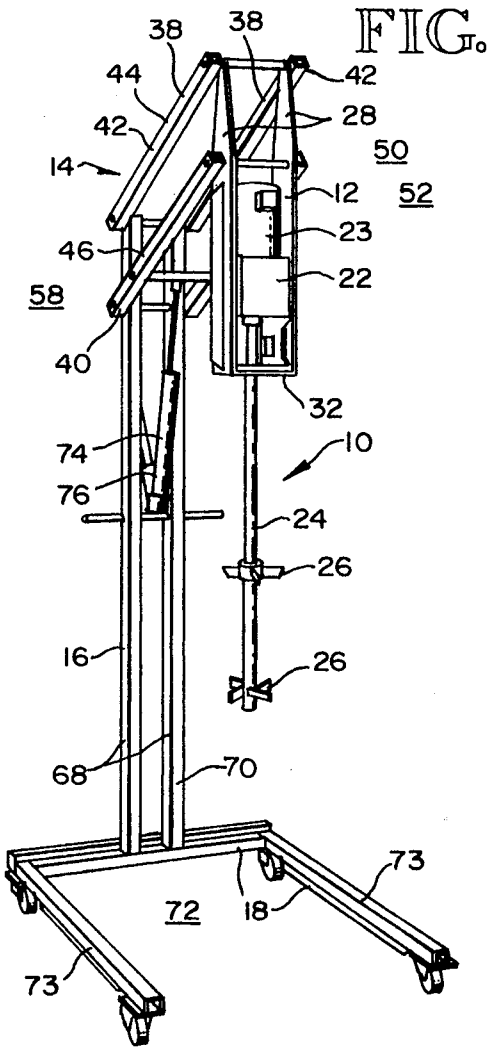
FIG. 1 is an isometric view of the mixer hoist showing a floor supported stand attached thereto.

Referring to FIG. 1, a mixer hoist is generally shown at 10. The mixer hoist 10 has three main components, a mixer mounting frame 12, a boom 14 and a support structure 16. Support structure 16 may in turn be supported by a dolly 18 which provides mobility.

Figure 3:
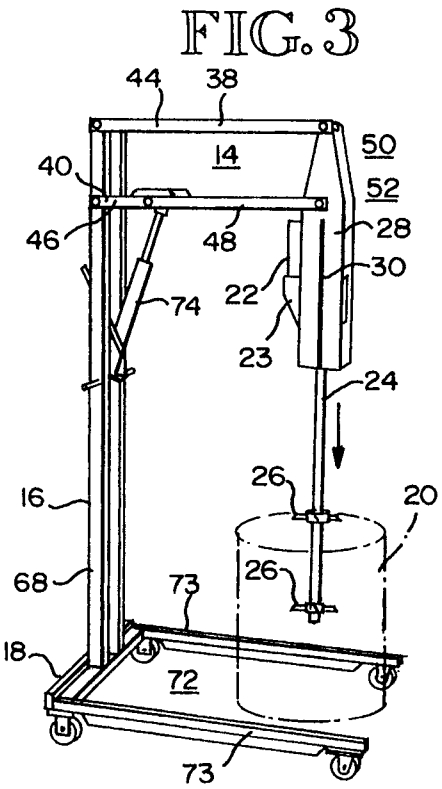
FIG. 3 is an isometric view of the mixer hoist showing the mixer positioned such that its shaft and impellers are within a container (shown in phantom)
Figure 2:
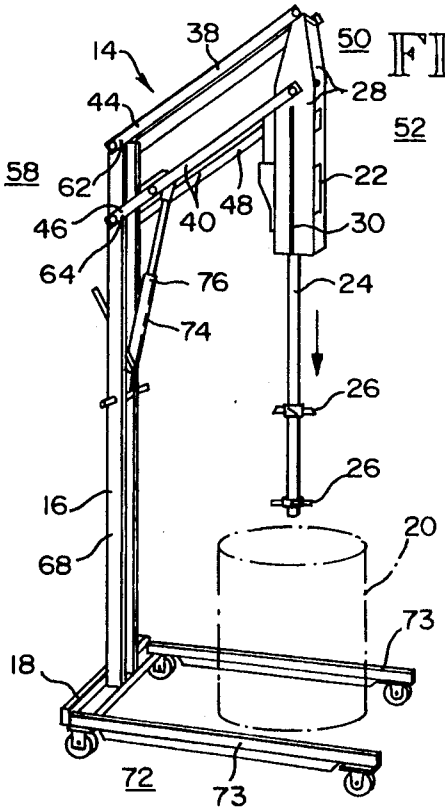
FIG. 2 is an isometric view of the mixer hoist showing the mixer and its associated shaft raised above the rim of a container.

Referring to FIG. 2, mixer hoist 10 is shown in a raised position around a container 20. In FIG. 3, the mixer hoist 10 is shown in a lowered position in relation to container 20 and is ready to commence mixing.

Referring again to FIG. 1, a mixer 22, including a mixer motor 23 (which may include a set of reduction gears) is mounted by a suitable means to the mixer mounting frame 12. The mixer 22 includes an impeller shaft 24 that extends downwardly from the mounting frame 12. A journal attachment can be used if motor 23 is remotely mounted. Located along the shaft 24 are one or more impellers 26 which perform the actual mixing. Mounting frame 12 includes a pair of side members 28 which are spaced apart a sufficient distance to accommodate mixer motor 23. Mounting frame side members 28 may be reinforced with a stiffener 30 appropriately attached, e.g., by welding. A mounting plate 32 is attached to side members 28 at their lower ends. An impeller shaft hole (not shown) is provided in mounting plate 32. The impeller shaft 24 extends through the impeller shaft hole to connect with the mixer motor 23. One or more impellers 26 are attached to impeller shaft 24. Impellers 26 may be of the vertical flat blade turbine type, a pitched blade turbine type or a combination of the two types.

Boom 14 includes spaced apart sets of parallelogram linkages which provide four pivotal connections at each end of the boom. An upper set of linkages 38 (first set) and a lower set (second set) of linkages 40 are assembled to form a parallelogram. Upper links 38 are a pair of spaced apart tubular frame members 42, 44. Lower links 40 are a pair of spaced apart tubular frame members 46, 48. Each of the four linkages 42, 44, 46, 48 have one end 50, 52, 54, 56 that is pivotally attached to side member 28 of the mixer mounting frame 12. The four point connection of the parallelogram linkages allows the mixer shaft to be moved linearly in a vertical fashion. The arrangement also allows the structure to resist rotational moments transmitted by the shaft. A more detailed description of this connection will be presented later on. The boom 14 is attached at its inboard end 58 to the support structure 16. Each of the four links 42, 44, 46, 48 has a corresponding end 60, 62, 64, 66, which are pivotally attached to support structure 16. The upper set of links 38 and the lower set of links 40 have their attachment points to the support structure 16 and the mixer mounting frame 12 nearly equally spaced, such that the upper links 38 and lower links 40 have a parallel relationship to each other, although they need not be exactly parallel.

Figure 5:
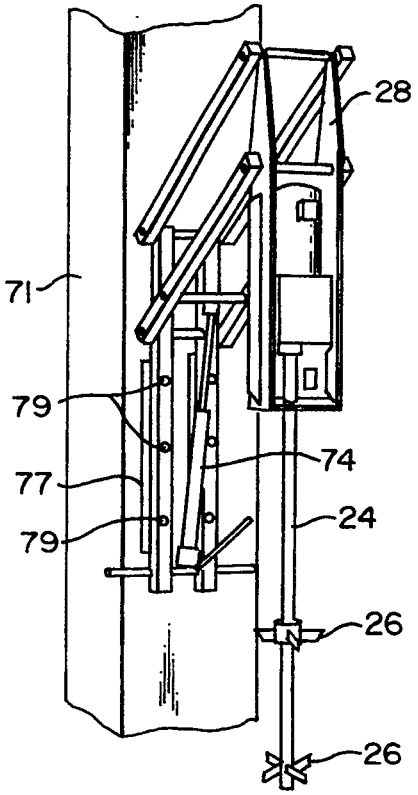
FIG. 5 is a perspective view of the present invention mounted on a column.
Figure 6:
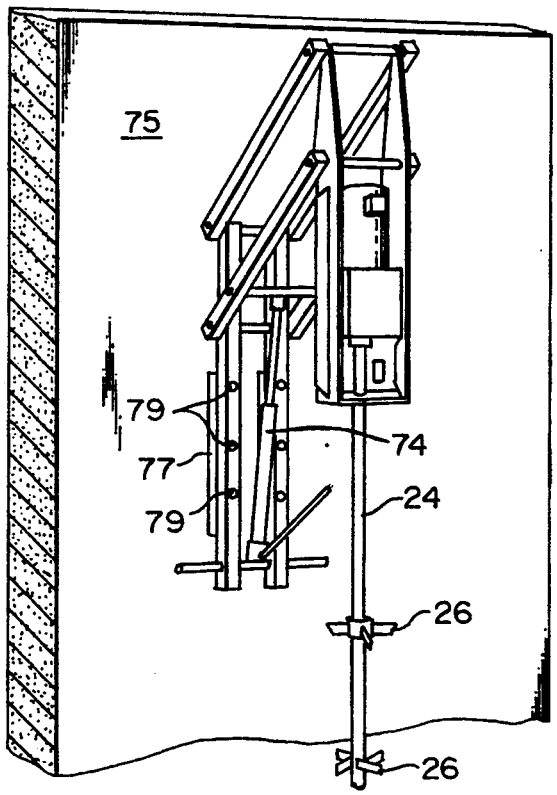
FIG. 6 is a perspective view of the present invention mounted on a wall.

The support frame 16 is made up of two spaced apart vertical frame members 68, 70. As shown in FIGS. 5 and 6 a portion of frame 6 can be attached to a structural portion of a building, such as a wall 71 or column 75. A spacer 77 may be used in conjunction with anchor bolts 79, or the like, for mounting purposes. In the case of mounting to column 71, bands or U-shaped bolts with a cross piece could be used. The support frame 16 has a lower end 72 that is attached by conventional means to dolly 18. The dolly's side members 73 are spaced apart such that they will fit on either side of a container such a 55 gallon drum and provide a stable base. The side members 73 may also be spaced and sized to fit under a standard shipping pallet. Dolly 18 is fitted with wheels or castors to increase mobility.

While any appropriate means may be used to swing the linkages about their pivotal connections 14, a linear actuator 74, e.g., a hydraulic cylinder, is perhaps the most convenient. In the preferred embodiment, a hydraulic jack 76 having a stroke of approximately 18 inches is used. A pivotal mounting base for the hydraulic jack 76 is mounted to the support frame 16 at an appropriate distance from its lower end 72. The other end of jack 76 is pivotally mounted to the boom 14. In the preferred embodiment, the jack is pivotally connected to the lower set of links 40 of the boom 14. The mounting location of this pivot point along the lower links 40 of the boom 14 is selected considering the weight of the mixer 22 and the capacity of the selected jack 76. Another consideration is the length of the impeller shaft 24, whereby the stroke of the jack and the location of the mount on the boom 14 is selected to insure that the outer end of the boom travels sufficiently to raise the impeller shaft 24 high enough to clear the top edge of the container and low enough such that efficient mixing is attained.

As can be seen in FIG. 2 and FIG. 3, impeller shaft 24 remains in a vertical orientation throughout the stroke of the jack 76.

Figure 4:
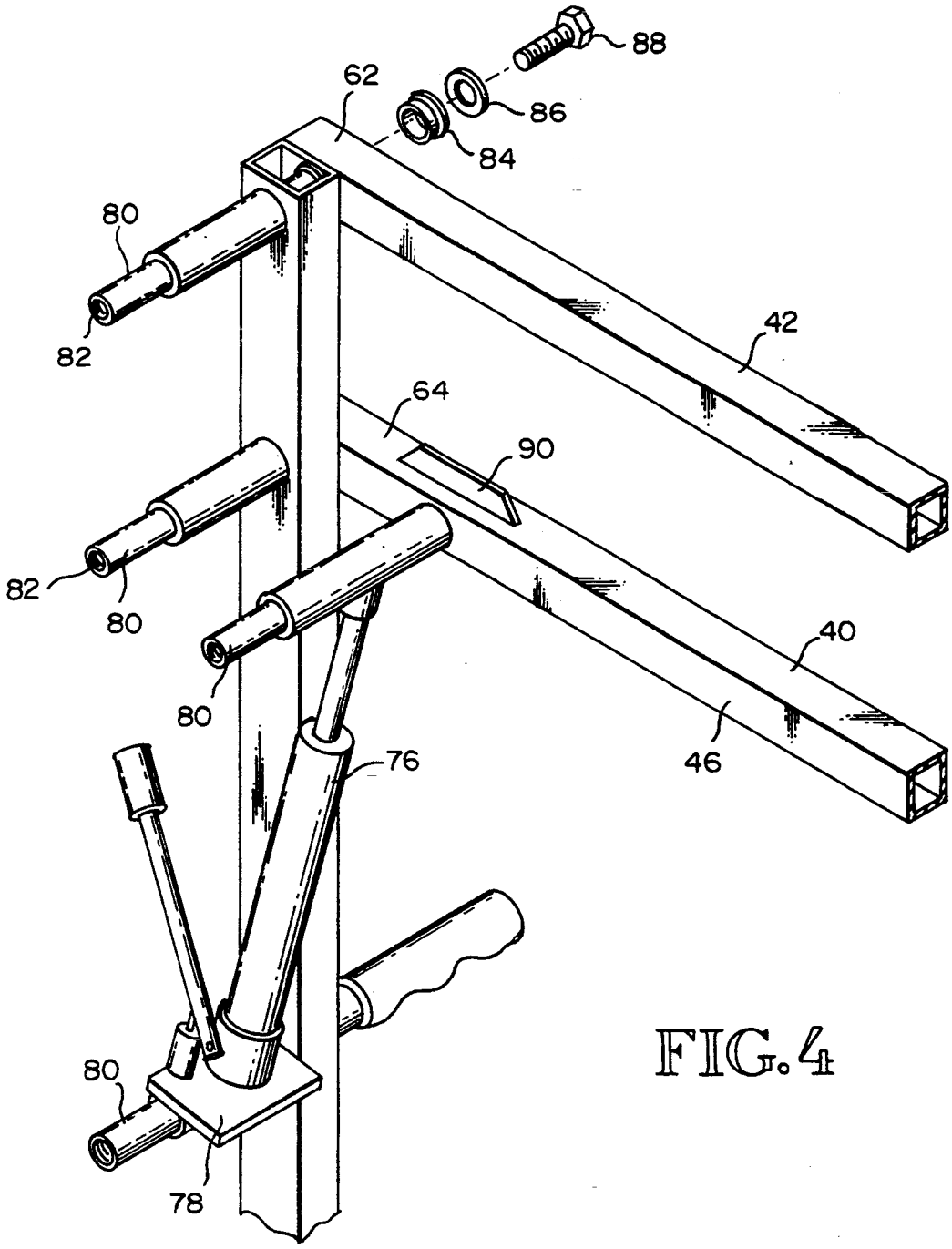
FIG. 4 is an enlarged and partially exploded view showing detail of the attachment of the links to the support structure and how the means for raising and lowering is attached to the boom and to the support structure.

Referring now to FIG. 4, all of the pivotal joints are similar in construction therefore only one will be described. An axle 80 having an internally threaded hole 82 at either end passes through a hole in frame member 38 and is then welded thereto. A bushing 84 is pressed into a hole formed in inboard end 62 of frame member 40 with a second bushing 84 being pressed into a hole on the opposite side. The bushings 84 have a length slightly greater than the thickness of the tube material used to make frame member 42. The axle 80 extends slightly beyond the outer surface of the bushing 84 and then a washer 86 and a bolt 88 are assembled to the axle 80. The bearing surface is therefore the ID of the bushing 84 and the OD of axle 80. This connection is similar in all applications of the pivot points within the boom 14. The mounting base 78 for the hydraulic jack 76 has a tube attached thereto, with an axle closely fitting therethrough with the axle being welded to the vertical support frame 16 after assembly.

As can be seen in FIG. 4, a stiffener 90 may be used to reinforce the tubular frame members.

The present invention has been described with reference to a preferred embodiment. Modifications and alterations may become apparent to one skilled in the art upon reading and understanding this specification. It is intended to include all such modifications and alterations within the scope of the appended claims and under interpretations of the doctrine of equivalence.

I claim:

1. A hoist for a power driven rotary shaft having journal attachment means thereon comprising, in combination;

an independent support structure, a boom comprising spaced apart sets of parallelogram linkages providing four point pivotal connections with said journal attachment means and said support structure, and a telescopic means for swinging said linkages about their pivotal connections, said telescopic means having one end supported by said independent support structure, whereby said shaft may be linearly translated and said four point connections resist rotational moments transmitted by said rotary shaft.

2. The hoist of claim 1, wherein said support structure includes a vertical frame having attachment means for mounting said frame to a structural portion of a building.

3. The hoist of claim 1, wherein said support structure includes a vertical frame having attachment means for mounting said frame to a column.

4. The hoist of claim 1, wherein said support structure includes a vertical frame member having connection means to a dolly, said dolly having side frame members which provide a stable base for said hoist.

5. The hoist of claim 1, wherein said boom's linkages include tubular frame members and said pivotal connections include an axle supported by bushings held in said tubular frame members.

6. The hoist of claim 5, wherein said support structure includes a vertical frame having attachment means for mounting said frame to a structural portion of a building.

7. The hoist of claim 5, wherein said independent support structure includes a tubular frame member having connection means for connection to a dolly, said dolly having side frame members which provide a stable base for said hoist.

8. The hoist of claim 1, wherein said rotary shaft includes a motor and mixer shaft having a mixing blade attached thereto.

9. The hoist of claim 1, wherein said means for swinging said linkages includes a hydraulic cylinder, said cylinder having one end pivotally attached to said support structure and the other end pivotally attached to said boom.

10. A mixer hoist for a power driven mixer unit with a substantially vertical rotary mixer shaft comprising, in combination;

an independent support structure, a boom comprising first and second laterally spaced sets of vertically spaced parallel links, each said links having their one ends pivotally connected to the mixer unit and the opposite ends thereof pivotally attached to said support structure providing parallelogram linkages with four point connections to said mixer unit and said support structure, and a telescopic means for raising and lowering said boom, said telescopic means having one end supported by said independent support structure, whereby said mixer shaft may be raised and lowered while maintaining its vertical orientation and said four point connections resist torque transmitted thereto during rotation of the mixing shaft.

11. The hoist of claim 10, wherein said support structure includes a vertical frame having attachment means for mounting said frame to a structural portion of a building.

12. The hoist of claim 10, wherein said support structure includes a vertical frame having attachment means for mounting said frame to a structural portion of a column.

13. The hoist of claim 10, wherein said support structure includes a vertical frame member having connection means to a dolly, said dolly having side frame members which provide a stable base for said hoist.

14. The hoist of claim 10, wherein said boom's linkages include tubular frame members and said pivotal connections include an axle supported by bushings held in said tubular frame members.

15. A hoist for a power driven mixer unit with a rotary mixer shaft comprising, in combination;

an independent support structure, a boom comprising first and second spaced sets of parallel links, each said links having their one ends pivotally connected to the mixer unit and the opposite ends thereof pivotally attached to said support structure providing parallelogram linkages with four point connections to said mixer unit and said support structure, said connection to said mixer unit being in the same plane as said mixer's shaft, and means for swinging said links about their pivotal connectors, whereby said shaft may be linearly translated and said four point connections resist torque transmitted thereto during rotation of said shaft.

16. A hoist according to claim 15, wherein said support structure includes a vertical frame supported by a structural portion of a building.

17. A hoist according to claim 15, wherein said support structure includes a vertical frame having a base support by a floor.

18. A hoist according to claim 17, wherein said base support includes a pair of side frames, each side frame being supported by a pair of wheels, and a crossmember connecting said side frames to the vertical frame.

19. A hoist according to claim 15, wherein a mounting bracket having an opening therein for receiving said mixer's shaft and mounting means for rotatably mounting one ends of said links thereto, and means for mounting said mixer to said mounting bracket.

* * * * *